US009759509B1

(12) United States Patent
Kempf et al.

(10) Patent No.: US 9,759,509 B1
(45) Date of Patent: Sep. 12, 2017

(54) PROJECTILE LAUNCHING DEVICE WITH SELF-TIMING AND WITHOUT CAM LEAN

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 15/433,054

(22) Filed: Feb. 15, 2017

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
See application file for complete search history.

(56) References Cited

U.S. PATENT DOCUMENTS 4,457,288 A 7/1984 Ricord
5,678,528 A * 10/1997 Hadley ..... F41B 5/12 124/24.1
7,637,256 B2 12/2009 Lee
8,651,095 B2 2/2014 Islas
9,494,379 B2 11/2016 Yehle

* cited by examiner

*Primary Examiner* — John Ricci
(74) *Attorney, Agent, or Firm* — Donald J. Ersler

(57) ABSTRACT

A projectile launching device includes self-timing without cam lean. The projectile launching device includes a riser, a rail, two energy storing components, (such as two limbs), two cams, a launch string, and least one cable. The ends of the launch string are attached to the two cams. Opposing ends of first and second cables are coupled to the rail. A mid-portion of the first and second cables are slidably engaged with the first and second cams, respectively. Alternatively, a single cable may replace the first and second cables. The two cams are preferably built as mirror images of each other at a centerline of the rail. The two cams include a launch string track, having identical, but mirrored, upper and lower cable tracks.

14 Claims, 10 Drawing Sheets

PROJECTILE LAUNCHING DEVICE WITH SELF-TIMING AND WITHOUT CAM LEAN

BACKGROUND OF THE INVENTION

1. Field of the Invention

The present invention relates generally to archery and more specifically to a shooting bow with a unique cable arrangement, which allows a portion of first and/or second cables to be coupled to first and second cams, and the ends of the cable(s) to be coupled back to an upper and/or lower post. This arrangement enables the device to be self-timing. The present invention may alternately use components other than flexible limbs for storing energy prior to launching the projectile.

2. Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However the inefficient use of tensioning devices severely limits the potential of this device. U.S. Pat. No. 8,651,095 to Islas discloses a bowstring cam arrangement for compound crossbow, which provides a method of removing the cables from the path of the string. U.S. Pat. No. 9,494,379 to Yehle discloses a crossbow, where Yehle relies on four cables. However, Yehle claims a helical cable track. Issues are created by having separate cables above and below the string track on each cam. If the cables are not of exact length, or if the upper cable stretches more than the lower cable, or visa-versa, the cables must be adjusted by the user to stay in time with each other. Timing of the cables can be a time consuming and a very difficult process.

The above inventions try to keep four cables in proper timing, as opposed to two. The present invention deals with the manner in which the cables are coupled to the cams of the bow or crossbow.

Accordingly, there is a clearly felt need in the art to provide a shooting bow, which allows a mid-portion of first and second cables to be operably coupled to first and second cams (or to exert a force in a plane substantially parallel to first and second cam tracks), and a first end of a cable coupled to a post above the plane of the launch string, and a second end of a cable coupled to a post below the plane of a shooting string, respectively. The cables do not cross the centerline of the shooting bow, or alternately a shooting bow with a launch string and having a single cable, which replaces two cables.

SUMMARY OF THE INVENTION

The present invention provides a projectile launching device with self-timing and no cam lean, which eliminates crossing cables. The projectile launching device with self-timing and without cam lean (projectile launch device) preferably includes a first cam, a second cam, a launch string and two cables, collectively known as a harness system, where neither end of the cable is coupled to the cam. This configuration allows a first end of first and second cables to be coupled to a first and second upper post, and the second end of the first and second cable to be coupled to a first and second lower cable post. Preferably, the first and second cables do not cross a centerline of the shooting bow. In a second preferred embodiment, the projectile launching device preferably includes a string latch housing, a bow riser, a rail, a first energy storing device, such as a first limb, a second energy storing device, such as a second limb, a first cam, a second cam, at least one bowstring, and two cables.

A third preferred embodiment uses a launch string and only one cable. A first end of first cable is coupled to a first upper cable post, wherein a portion of the first cable is journaled to the first cable boss; crosses to the second cam; another portion is journaled to the second cable boss; and the second end of the cable is journaled to the second upper cable post.

The term "limb" may refer to what are known as solid limbs, split-limbs, tube-limbs, or any other flexible energy storing component. The bow riser is enjoined with the rail. One end of the first limb extends from a first end of the bow riser and one end of the second limb extends from a second end of the bow riser. The first cam is pivotally retained on a distal end of the first limb and the second cam is pivotally retained on a distal end of the second limb. A first end of the launch string is retained by the first cam and a second end of the launch string is retained by the second cam. A first upper cable post and a first lower cable post is located on a first side of a centerline of the rail and a second upper cable post and a second lower cable post are located on a second side of the centerline of the rail. The first cam includes a first cam launch string track, an upper first cam cable track, located above the launch string track, a first cam cable boss, and a lower first cam cable track, located below the launch string track. The second cam includes a second cam launch string track, an upper second cam cable track, located above the launch string track, a second cam cable boss, and a lower second cam cable track, located below the launch string track.

The first and second upper cable posts are located above the plane of the launch string, and the first and second lower cable posts are located below the plane of the launch string. A first end of the first cable is coupled to the first upper cable post; a segment of the first cable before a middle of the first cable partially engages the first cam upper cable track; the middle of the first cable partially wraps around the first cam cable boss; a segment of the first cable after the middle of the first cable partially engages the first cam lower cable track; and a second end of the first cable is coupled to the first lower cable post. A first end of the second cable is coupled to the second upper cable post; a segment of the second cable before a middle of the second cable partially engages the second cam upper cable track; the middle of the second cable partially wraps around the second cam cable boss; a segment of the second cable after the middle of the second cable partially engages the second cam lower cable track; and a second end of the second cable is coupled to the second lower cable post.

When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the upper and lower cable tracks of the first and second cams.

A unique feature of the present invention is that the first and second cables are not firmly fixed to the cams in any way, rather they "float" or slide relative to the first and second cam bosses. The first and second cables are of one piece, and as the cable stretches, it self-centers itself on the boss.

In a preferred embodiment, the launch string may be releasably retained in the ready-to-fire position by mechanisms known as a string latch assembly or a string release.

In a first preferred alternative embodiment, the launch string may be held in the ready-to-fire position and released by the users' fingers.

In a second preferred alternative embodiment, a rail-less crossbow design may be used.

In a third preferred alternative embodiment, the same harness system configuration may be used on projectile launching devices utilizing energy storing components other than flexible limbs. These other types of energy storing components include spring(s), hydraulics, or pressurized cylinder(s).

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

Accordingly, there is a clearly felt need in the art for a projectile launching device with no cam lean, having a first cam, a second cam, a launch string and two cables, collectively known as a harness system, where neither end of the cable is rigidly attached to the cam.

These and additional objects, advantages, features and benefits of the present invention will become apparent from the following specification.

DETAILED DESCRIPTION OF THE PREFERRED EMBODIMENTS

Figure 1:
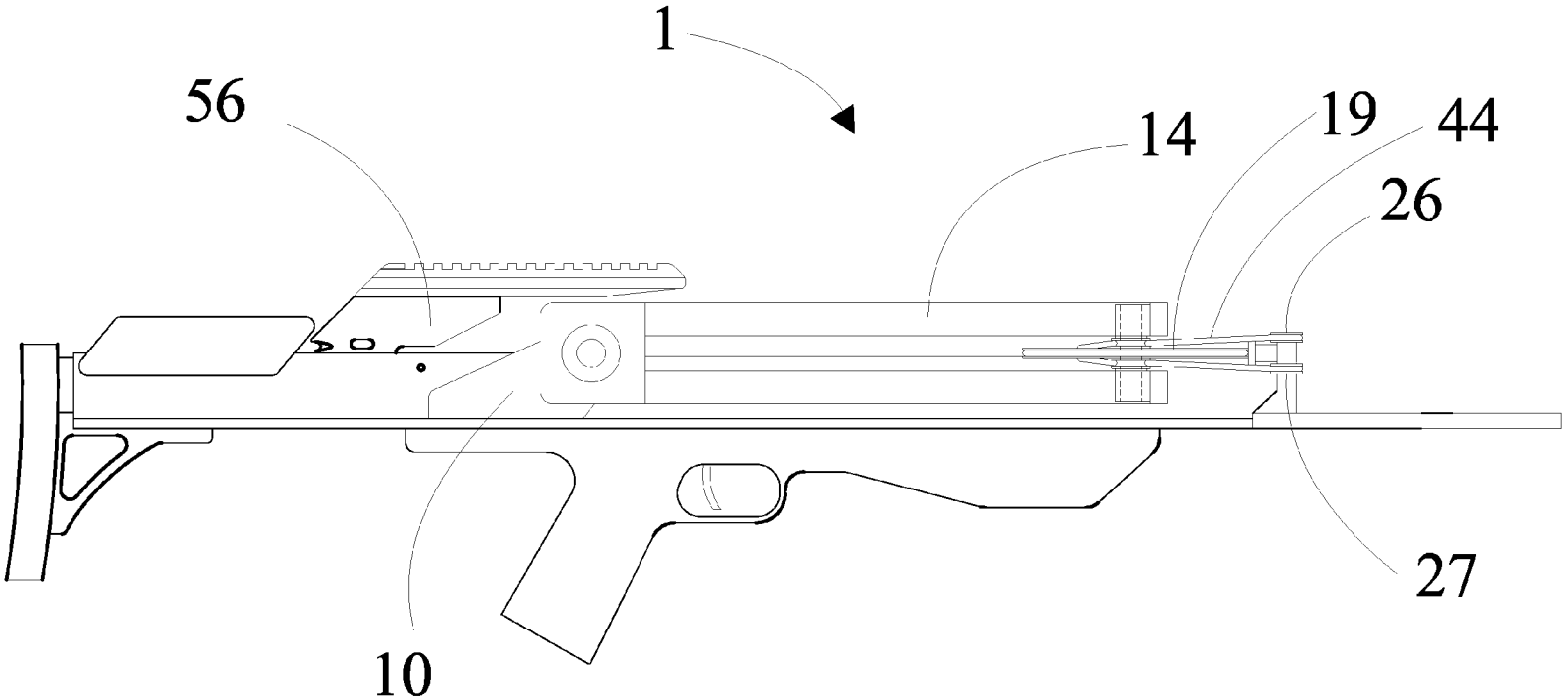
FIG. 1 is a side view of a crossbow with no cam lean in accordance with the present invention.
Figure 2:
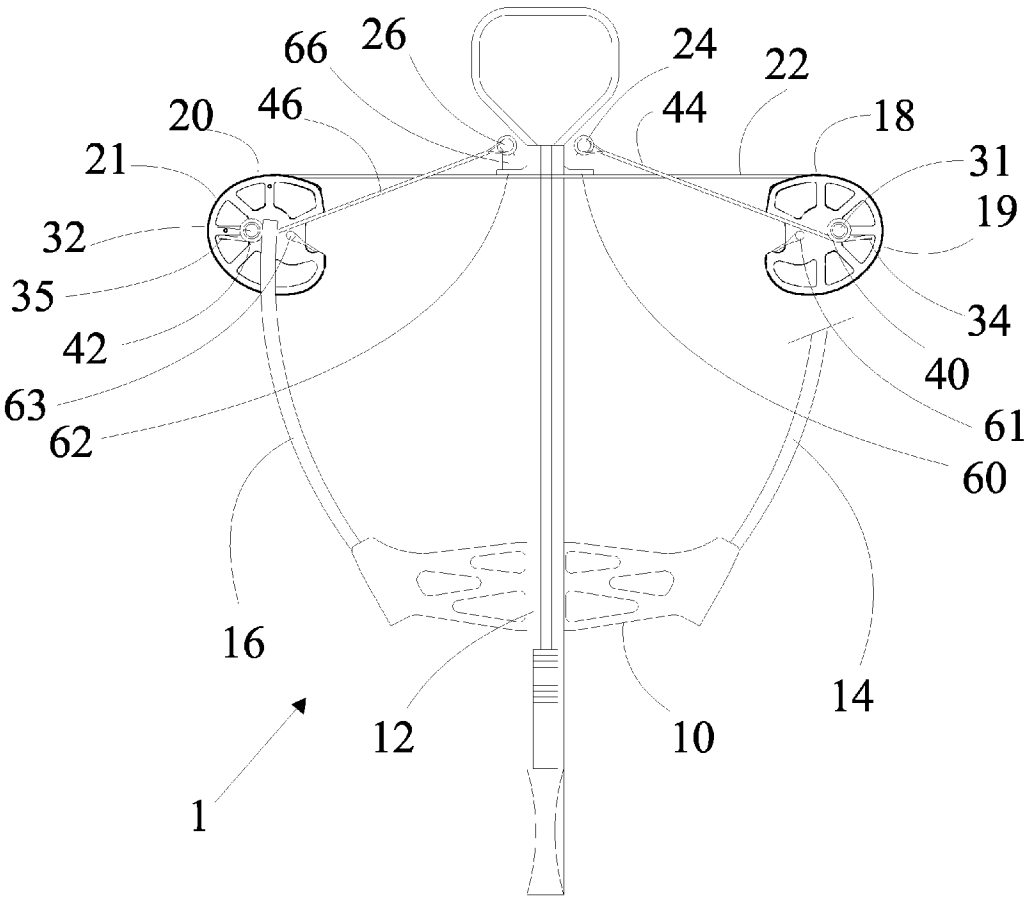
FIG. 2 is a top view of a crossbow with no cam lean, where the cable tracks are mostly round, and the launch string is at rest in accordance with the present invention.
Figure 3:
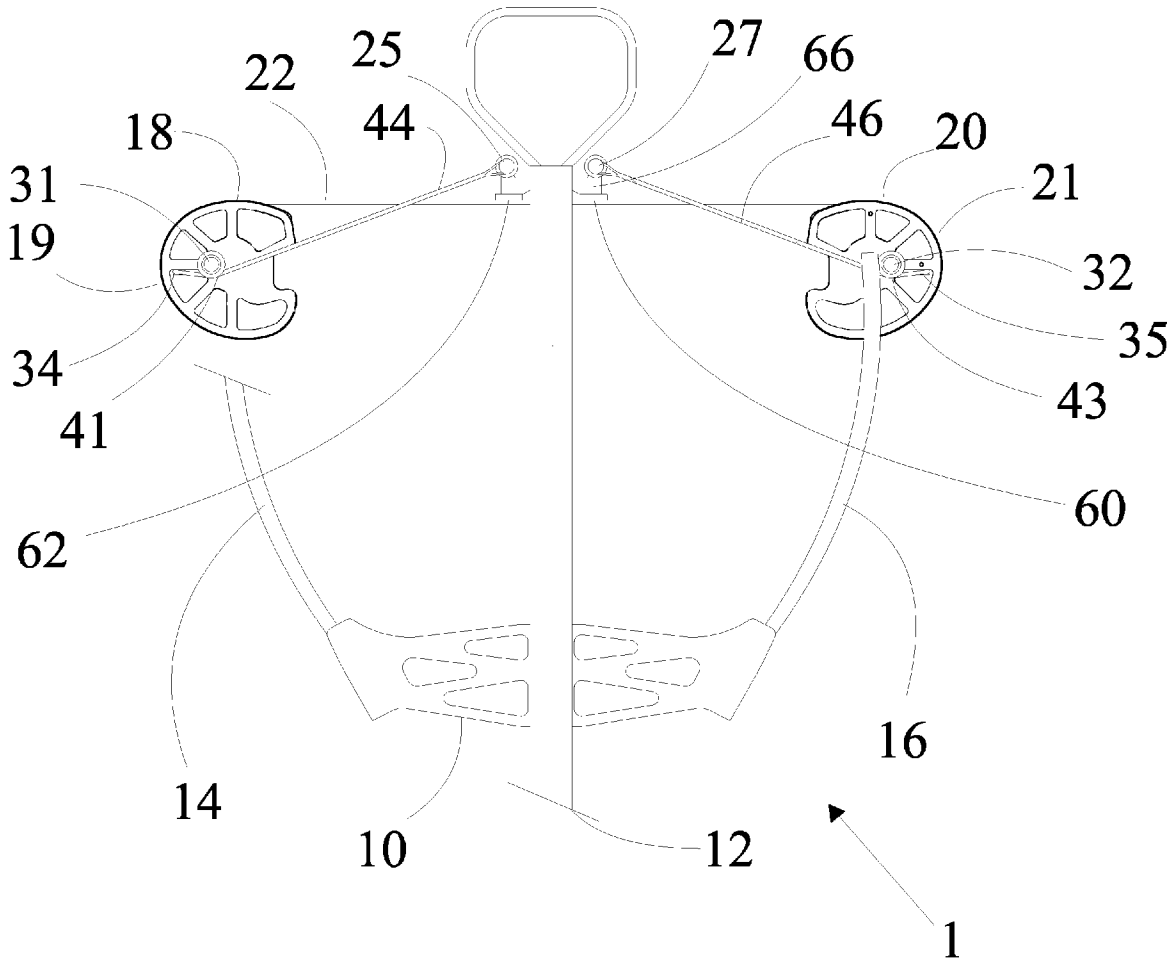
FIG. 3 is a partial bottom view of a crossbow with no cam lean, where the cable tacks are mostly round, and the launch string is at rest in accordance with the present invention.
Figure 4:
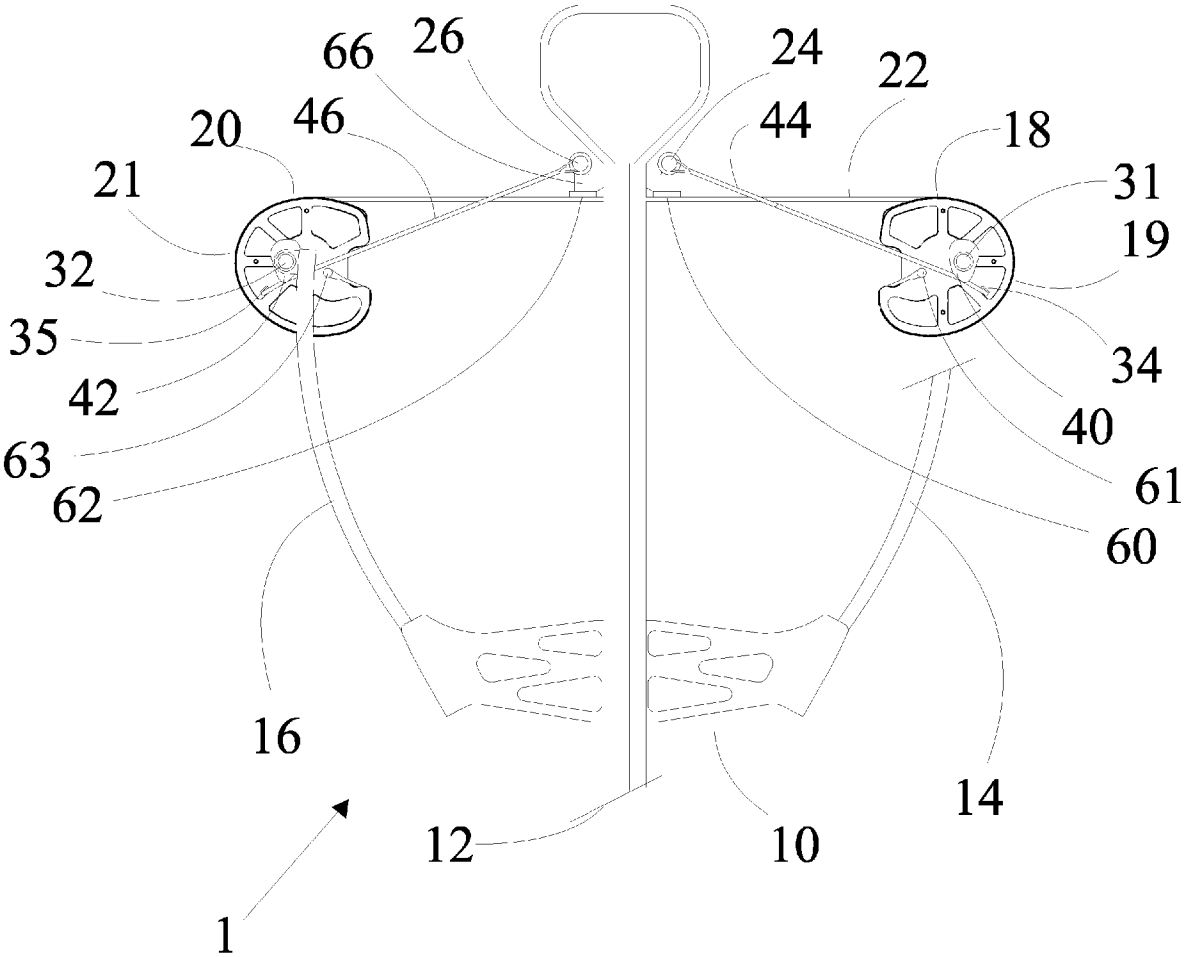
FIG. 4 is a partial top view of a crossbow with zero cam lean, where the cable track is not round, and the launch string is at rest in accordance with the present invention.
Figure 5:
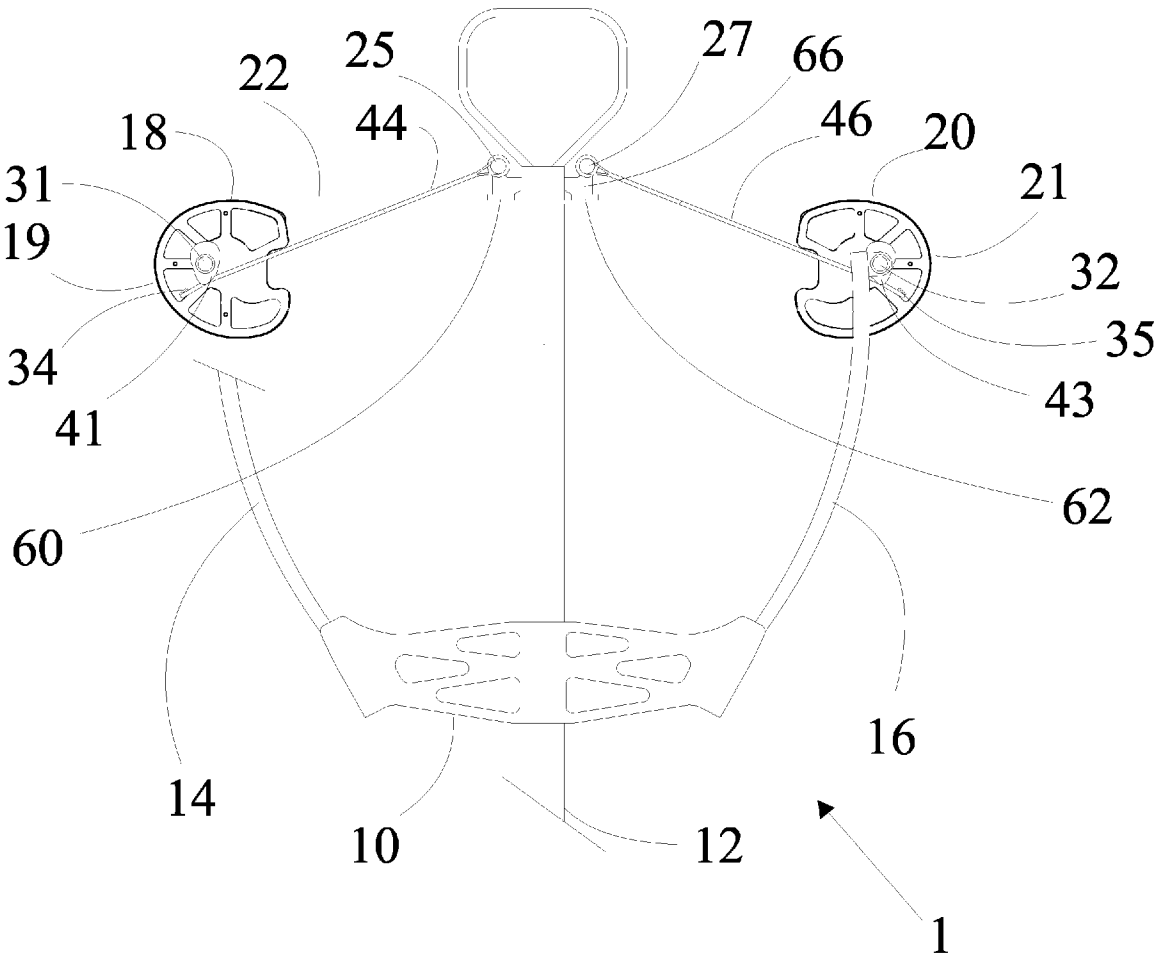
FIG. 5 is a partial bottom view of a crossbow with zero cam lean, where the cable track is not round, and the launch string is at rest in accordance with the present invention.
Figure 6:
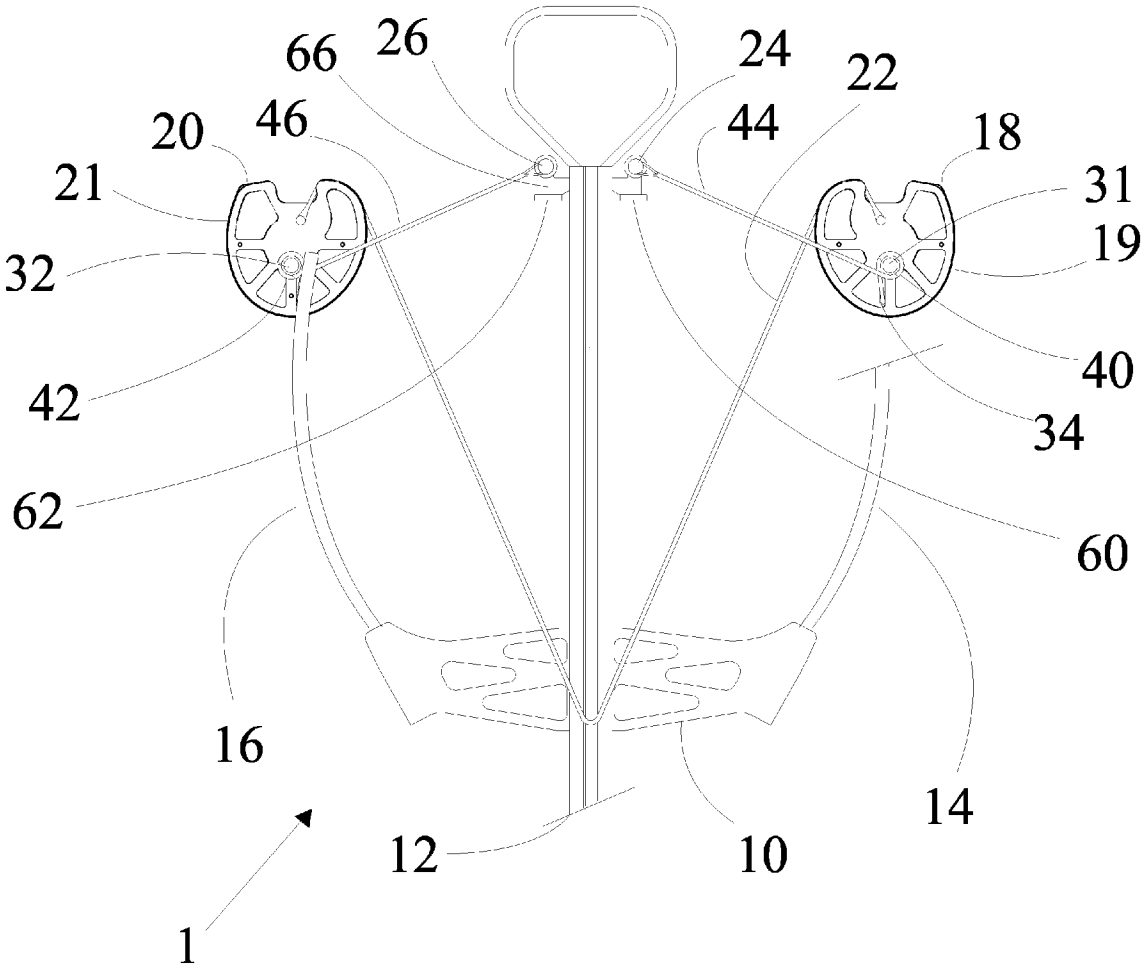
FIG. 6 is a partial top view of a crossbow with zero cam lean, where the cable track is mostly round, and the launch string is in a ready-to-fire position in accordance with the present invention.
Figure 7:
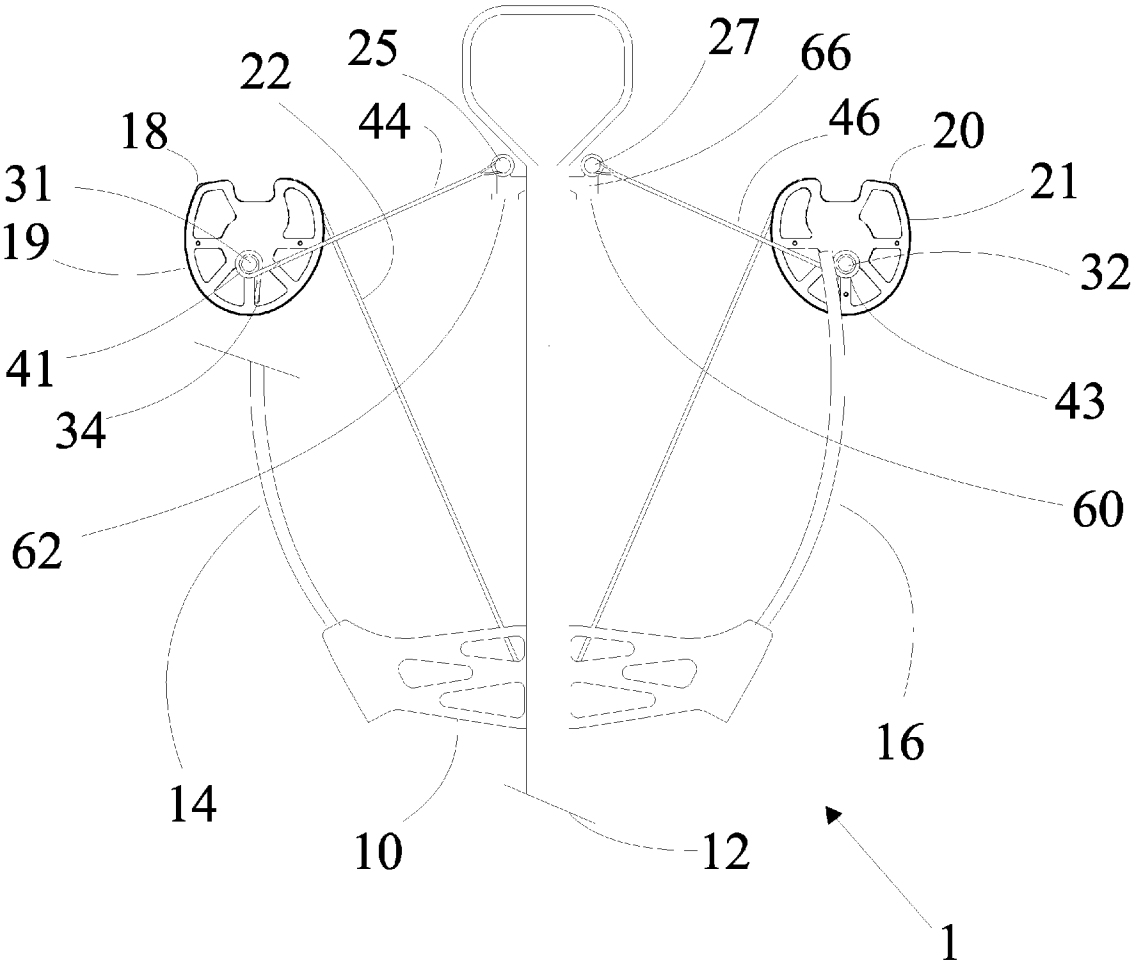
FIG. 7 is a partial bottom view of a crossbow with zero cam lean, where the cable track is mostly round, and the launch string is in a ready-to-fire position, in accordance with the present invention.
Figure 8:
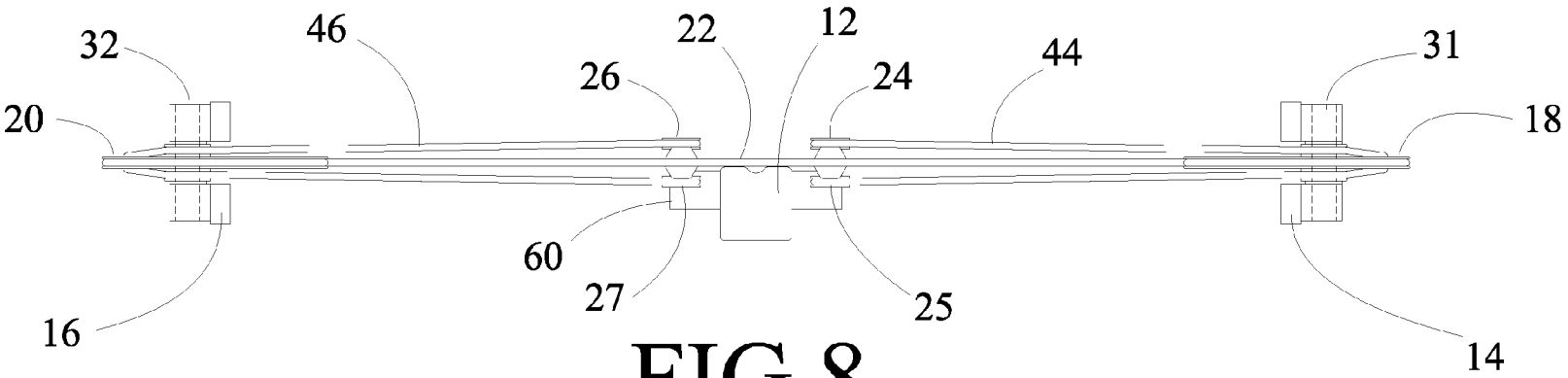
FIG. 8 is a cut away view of a crossbow with zero cam lean, looking forward, just behind the cams, showing the launch string and routing of the cables, in accordance with the present invention.
Figure 9:
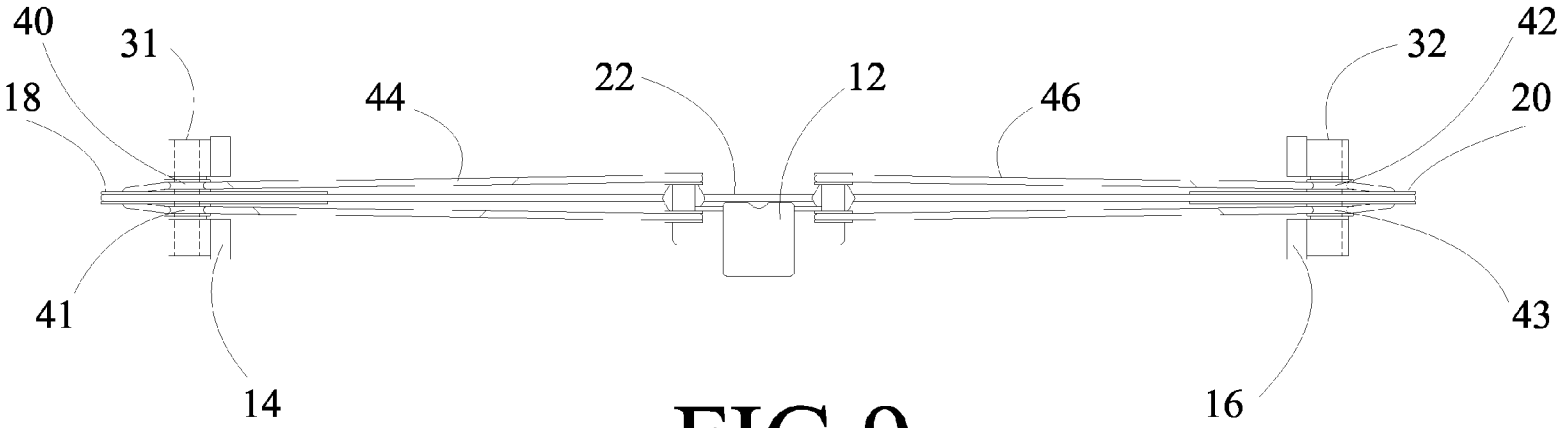
FIG. 9 is a front view of a crossbow with zero cam lean with a stirrup removed, looking at the front of the crossbow, showing the launch string and routing of the cables, in accordance with the present invention.

With reference now to the drawings, FIG. 1 shows a side view of a projectile launching device 1, which includes a operably releasable launch string housing 56 coupled to a rail 12. With reference to FIGS. 2-6, the projectile launching device 1 preferably includes a bow riser 10, a rail 12, a first limb 14, a second limb 16, a first cam 18, a second cam 20 and at least one launch string 22. The bow riser 10 may be joined with the rail 12 in any method known to join two pieces, as well as the rail 12 and the riser 10 being formed together as a single unit. A first end of the first limb 14 is coupled to a first end of the bow riser 10 and a first end of the second limb 16 is coupled to a second end of the bow riser 10. The first cam 18 is pivotally retained on an opposing end of the first limb 14 and the second cam 20 is pivotally retained on an opposing end of the second limb 16.

The first cam 18 includes a first launch string track 19, a first cam upper cable track 40, a first cam launch string post 61, a first cam boss 34, and a first cam lower cable track 41. The second cam 20 includes a second launch string track 21, a second cam upper cable track 42, a second cam launch string post 63, a second cam boss 35, and a second cam lower cable track 43. The first and second cam bosses 34, 35 preferably have a round diameter. A first end of the launch string 22 is retained by the first cam launch string post 61, a portion of the span of the launch string 22 at least partially wraps the first cam 18 in the first cam launch string track 19, a portion of the span of the launch string 22 at least partially wraps the second cam 20 in the second cam launch string track 21, and a second end of the bowstring 22 is retained by the second cam launch string post 63.

A first end of a first cable 44 is coupled to a first upper cable post 24, a segment of the first cable 44 before the center of the cable 44 partially engages the first cam upper cable track 40, the middle of the first cable partially wraps around the first cam cable boss 34, a segment of the first cable 44 after the center of the first cable 44 partially engages the first cam lower cable track 41, and the second end of the first cable 44 is coupled to the first lower cable post 25. The first cable 44 does not cross the rail 12. A first end of a second cable 46 is coupled to a second upper cable post 26, a segment of the second cable 46 before the center of the second cable 46 partially engages the second cam upper cable track 42, the middle of the second cable 46 partially wraps around the second cam cable boss 35, a segment of the second cable 46 after the center of the second cable 46 partially engages the second cam lower cable track 43, and the second end of the second cable 46 is coupled to a second lower cable post 27. The first and second upper cable posts 24, 26 are located above a horizontal plane of the first and second cams 18, 20. The first and second lower cable posts 25, 27 are located below a horizontal plane of the first and second cams 18, 20. The second cable 46 does not cross the rail 12.

With reference to FIGS. 6-9, when the launch string 22 is drawn from an at rest position to a ready to fire position, the first cam 18 rotates in a first direction, and the second cam 20 rotates in a second direction. As the cams 18 and 20 rotate, the launch string 22 is unwound from the first and second launch string tracks 19 and 21. Simultaneously, the cables 44 and 46 wind into the upper 40 and 42 and lower 41 and 43 cable tracks of the first 18 and second 20 cams. When the launch string 22 has been drawn to the ready-to-fire position, it may be held in this the position by an operably releasable catch located in a housing 56. The first cable 44 is slidable relative to the first cam cable boss 34 and the second cable 46 is slidable relative to the second cam cable boss 35.

Figure 10:
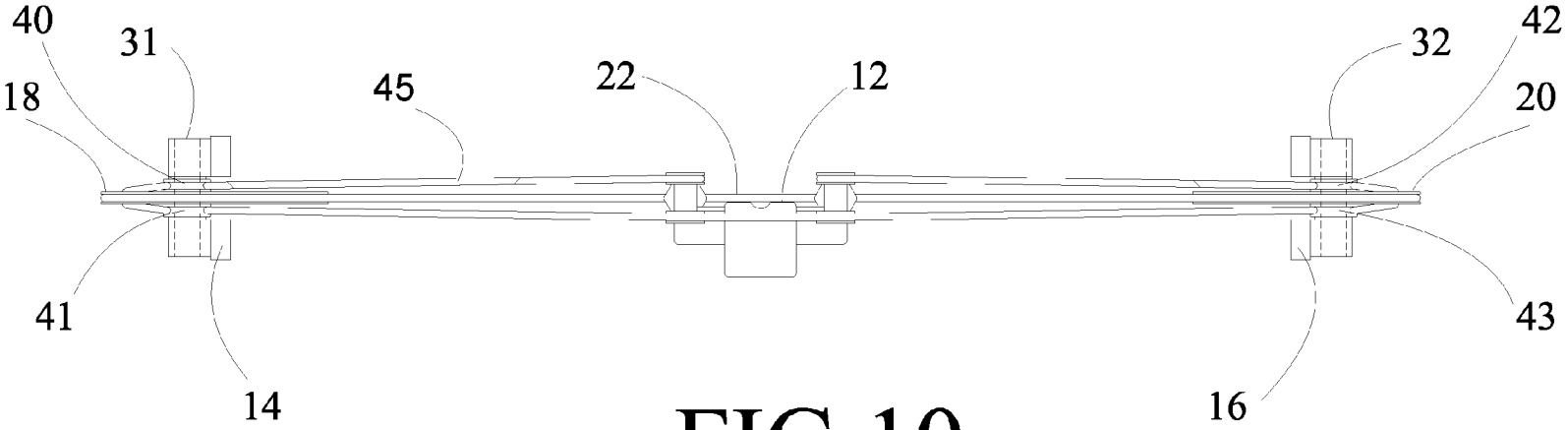
FIG. 10 is a front view of a crossbow with zero cam lean with a stirrup removed, looking at the front of the crossbow, showing the launch string and routing of the single cable, in accordance with the present invention.

With reference to FIG. 10, an alternate embodiment uses the launch string 22 and a single cable 45. A first end of the single cable 45 is attached to the first upper cable post 24, a span of the single cable 45 is retained on the first cam boss 34 of the first cam 18, crosses a center-line of the rail 12, is retained on the second cam boss 35 of the second cam 20, and a second end of the single cable 45 is attached to the second upper cable post 26. The single cable 45 replaces first and second cables 44, 46.

It is preferable for both single and double cable designs that a vertical distance between the lower cable tracks 41, 43 and the string launch track 19, 21 be equal to a vertical distance between the upper cable tracks 40, 42 and the string launch track 19, 21. However, the projectile launching device 1 will function satisfactory without the above vertical distance conditions. It is also preferable that the cables 44, 45, 46 be parallel to the launch string 22. However, the projectile launching device 1 will function satisfactory without the parallel conditions.

While the preferred embodiment of the invention has been illustrated and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A projectile launching device without cam lean includes a rail, a riser, a first energy storing component, a second energy storing component, the riser is attached to the rail, one end of the first energy storing component is attached to a first end of the riser, one end of the second energy storing component is attached to a second end of the riser, comprising:

a first cam is capable of being pivotally retained on the first energy storing component, said first cam includes a first launch string track, a first upper cable track, a first lower cable track and a first cable boss, said first upper cable track is located above said first launch string track, said first lower cable track is located below said first launch string track, said first cable boss extends from an edge of said first cam;

a second cam is capable of being pivotally retained on the second energy storing component, said second cam includes a second launch string track, a second upper cable track, a second lower cable track and a second cable boss, said second upper cable track is located above said second launch string track, said second lower cable track is located below said second launch string track, said second cable boss extends from an edge of said second cam, wherein said first and second launch string tracks are capable of retaining a launch string;

a first cable having one end coupled to said rail, said first cable is retained in said first upper cable track, said first cable passes through said first cam, said first cable is slidably engaged with said first cam boss, said first cable is retained in said first lower cable track, an opposing end of said first cable is attached to said rail; and a second cable having one end coupled to said rail, said second cable is retained in said second upper cable track, said second cable passes through said second cam, said second cable is slidably engaged with said second cam boss, said second cable is retained in said second lower cable track, an opposing end of said second cable is attached to said rail.

2. The projectile launching device without cam lean of claim 1 wherein:

said first and second cables are substantially parallel to said launch string.

3. The projectile launching device without cam lean of claim 1 wherein:

a first distance between said upper cable track and said launch string track is equal to a second distance between said lower cable track and said launch string track.

4. The projectile launching device without cam lean of claim 1, further comprising:

a first upper cable post extends from a first side of the rail, above a plane of said first and second cams, a first lower cable post extends from the first side of the rail below said plane of said first and second cams.

5. The projectile launching device without cam lean of claim 1, further comprising:

a second upper cable post extends from a second side of the rail, above a plane of said first and second cams, a second lower cable post extends from the second side of the rail below said plane of said first and second cams.

6. A projectile launching device without cam lean includes a rail, a riser, a first energy storing component, a second energy storing component, the riser is attached to the rail, one end of the first energy storing component is attached to a first end of the riser, one end of the second energy storing component is attached to a second end of the riser, comprising:

a first cam is capable of being pivotally retained on the first energy storing component, said first cam includes a first launch string track, a first upper cable track, a first lower cable track and a first cable boss, said first upper cable track is located above said first launch string track, said first lower cable track is located below said first launch string track, said first cable boss extends from an edge of said first cam;

a second cam is capable of being pivotally retained on the second energy storing component, said second cam includes a second launch string track, a second upper cable track, a second lower cable track and a second cable boss, said second upper cable track is located above said second launch string track, said second lower cable track is located below said second launch string track, said second cable boss extends from an edge of said second cam, wherein said first and second launch string tracks are capable of retaining a launch string; and a cable having one end coupled to said rail, said cable is retained in said first upper cable track, said cable passes through said first cam, said cable is slidably engaged with said first cam boss, said cable is retained in said first lower cable track, said cable extends across the rail, said cable is retained in said lower cable track, said cable passes through said second cam, said second cable is slidably engaged with said second cam boss, said cable is retained in said second upper cable track, an opposing end of said cable is attached to said rail.

7. The projectile launching device without cam lean of claim 6 wherein:

said cable is substantially parallel to said launch string.

8. The projectile launching device without cam lean of claim 6 wherein:

a first distance between said upper cable track and said launch string track is equal to a second distance between said lower cable track and said launch string track.

9. The projectile launching device without cam lean of claim 6, further comprising:

a first upper cable post extends from a first side of the rail, above a plane of said first and second cams, a second upper cable post extends from a second side of the rail, above said plane of said first and second cams.

10. A projectile launching device without cam lean includes a rail, a riser, a first energy storing component, a second energy storing component, the riser is attached to the rail, one end of the first energy storing component is attached to a first end of the riser, one end of the second energy storing component is attached to a second end of the riser, comprising:

a first cam is capable of being pivotally retained on the first energy storing component, said first cam includes a first launch string track, a first upper cable track, a first lower cable track and a first cable boss, said first upper cable track is located above said first launch string track, said first lower cable track is located below said first launch string track, said first cable boss extends from an edge of said first cam;

a second cam is capable of being pivotally retained on the second energy storing component, said second cam includes a second launch string track, a second upper cable track, a second lower cable track and a second cable boss, said second upper cable track is located above said second launch string track, said second lower cable track is located below said second launch string track, said second cable boss extends from an edge of said second cam, wherein said first and second launch string tracks are capable of retaining a launch string;

a first cable having one end coupled to said rail, said first cable is retained in said first upper cable track, said first cable passes through said first cam, said first cable is slidably engaged with said first cam boss, said first cable is retained in said first lower cable track, an opposing end of said first cable is attached to said rail, said first cable does not cross the rail; and a second cable having one end coupled to said rail, said second cable is retained in said second upper cable track, said second cable passes through said second cam, said second cable is slidably engaged with said second cam boss, said second cable is retained in said second lower cable track, an opposing end of said second cable is attached to said rail, said second cable does not cross the rail.

11. The projectile launching device without cam lean of claim 10 wherein:

said first and second cables are substantially parallel to said launch string.

12. The projectile launching device without cam lean of claim 10 wherein:

a first distance between said upper cable track and said launch string track is equal to a second distance between said lower cable track and said launch string track.

13. The projectile launching device without cam lean of claim 10, further comprising:

a first upper cable post extends from a first side of the rail, above a plane of said first and second cams, a first lower cable post extends from the first side of the rail below said plane of said first and second cams.

14. The projectile launching device without cam lean of claim 10, further comprising:

a second upper cable post extends from a second side of the rail, above a plane of said first and second cams, a second lower cable post extends from the second side of the rail below said plane of said first and second cams.

* * * * *